United States Patent [19]

Rice, Sr.

[11] Patent Number: 4,597,550

[45] Date of Patent: Jul. 1, 1986

[54] POTTED PLANT DISPLAY STAND

[76] Inventor: Quay D. Rice, Sr., 2917 Hampshire Dr., Augusta, Ga. 30909

[21] Appl. No.: 738,246

[22] Filed: May 28, 1985

[51] Int. Cl.[4] ..... A47G 23/02

[52] U.S. Cl. ..... 248/146; 47/39; 248/346

[58] Field of Search ..... 248/146, 148, 176, 346, 248/346.1, 519, 514; 47/39, 41 R; 211/71, 74

[56] References Cited

U.S. PATENT DOCUMENTS

| | | | |
|---|---|---|---|
| 1,058,818 | 4/1913 | Waldron et al. | 248/148 |
| 1,159,372 | 11/1915 | Goff | 248/148 X |
| 1,314,549 | 9/1919 | Harding | 248/519 X |
| 1,336,307 | 4/1920 | Loudon . | |
| 1,502,385 | 7/1924 | Hauenstein . | |
| 1,572,444 | 2/1926 | Mueller . | |
| 2,563,405 | 9/1951 | O'Malley | 211/133 |
| 2,633,248 | 3/1953 | Goldenberg | 248/346.1 X |
| 2,764,845 | 10/1956 | Colombini | 47/34 |
| 2,779,313 | 1/1957 | Touney | 248/146 X |
| 2,781,065 | 2/1957 | Hofacer | 141/106 |
| 3,262,665 | 7/1966 | Black | 248/153 |
| 3,711,048 | 1/1973 | Thalenfeld | 248/309 |
| 3,831,209 | 8/1974 | Clingman | 248/346.1 |
| 3,964,709 | 6/1976 | La Belle et al. | 211/74 X |

*Primary Examiner*—Ramon O. Ramirez

*Attorney, Agent, or Firm*—Benoni O. Reynolds

[57] ABSTRACT

A potted plant display stand for displaying a small potted plant at angles, varying from 20 to 70 degrees, to the horizontal, for fuller viewing by a bedridden patient. The base of the stand is a hollow, dome-like shell, circular in shape, for placing the stand securely on a horizontal surface. The base is constructed (preferably molded) of thin material, such as plastic, for lightness and to facilitate the nesting of two or more stands in a reduced space. The potted plant is held in a cup-like circular recess in the side of the stand which recess is slightly larger in circumference than the outer circumference of the pot being held. The circular recess has a narrow overhanging lip across the top to frictionally hold the pot in place. A hollow area beneath the circular recess permits the nesting of stands of like dimensions, one on top of another. A modification of circular recess dimensions permits the nesting of smaller stands within slightly larger stands.

2 Claims, 5 Drawing Figures

POTTED PLANT DISPLAY STAND

BACKGROUND OF THE INVENTION (1) Field of the Invention

This invention relates to apparatus for displaying flowers. In particular, it relates to apparatus for displaying small potted plants at bedside for patients in hospitals.

(2) Description of Prior Art

Small potted plants have always been a favorite gift to cheer up bedridden patients in hospitals. When displayed in sick rooms, the blooms of the plants are not really seen to their full advantage by the patient because the blooms are straight up. The pot containing the small plant is usually placed on a shelf, window sill or on a nearby piece of furniture where the plant is seen only in profile by the patient.

There have been various display stands developed in the prior art but none appear to meet the needs of the bed-ridden patient as efficiently and economically as does the present invention. Early plant stands, such as that of Loudon (1920), were large, complicated, expensive and required tools for some adjustments. Objectives of these earlier inventions were to gain more advantage of the sunlight and to provide better viewing at flower shows. Other early display apparatus, such as that of Mueller (1926), combined a vase and a display rack to facilitate the showing of cut flowers on one hand or a plant on the other hand. Support methods contained many parts, were crude in construction, often unstable, and due to their bulk or design, suitable only for placement on a floor rather than at eye level.

Most of the prior art stands were not light and "stackable" for storage, as is provided in the present invention. Also most prior art devices contained two or more parts as opposed to the single integral unit of the present invention. Holders from other arts are not suitable to meet the objectives of the present invention because these holders were designed for utilitarian purposes, rather than for displays, and had no esthetic appeal.

Later apparatus, such as Colombini's Plant Receptacle (1956), had many parts and was designed for knock-down and quick assembly. Easy shipment at reduced rates and interchangeability of parts were the objectives, rather than improved display for a viewer. His receptacle resembled a wheelbarrow and would be far too large for hospital use where only limited space, such as shelves, window sills or tops of furniture, are available for displaying small potted plants. Black (1966) approached the problem by means of external devices for fastening to pots. External bracing consisting of heavy wire was used in conjunction with a collar having a plurality of recesses. This bracing means lacked in simplicity and stability of the present invention.

One more recent displayholder for artificial flowers required the use of auxiliary supports such as peg boards and internal grid work (Thalenfeld—1973). Prior art known to this inventor includes the following U.S. Pat. Nos. 1,336,307, 4/1920, Loudon; 1,502,385, 7/1924, Hauenstein; 1,572,444, 2/1924, Mueller; 2,563,405, 9/1951, O'Malley; 2,764,845, 10/1956, Colombini; 2,781,065, 2/1957, Hofacer; 3,262,665, 7/1966, Black; 3,711,048, 1/1973, Thalenfeld; 3,831,209, 8/1974, Clingman.

BRIEF SUMMARY OF THE INVENTION

The present invention is a potted plant display stand for displaying small potted plants at varying degrees to the horizontal. The apparatus is particularly valuable for providing fuller viewing of the plant by a bed-ridden patient in a hospital.

According to the preferred embodiment of this invention, the apparatus for displaying the small potted plant has a base means for supporting the apparatus on a horizontal surface, such as a shelf, window ledge or bedside table. The base means is a hollow, dome-like shell, circular in shape, constructed (preferably molded) of a thin, lightweight material, such as plastic. A holding means is provided in the apparatus for holding a small potted plant at an inclined angle to the horizontal (varying from 20 to 70 degrees), for ease of viewing the contents of the apparatus by a bedridden observer. The holding means is a cup-like, circular recess in the side of the apparatus, the circular recess being slightly larger in circumference than the outer circumference of the pot being held. The circular recess has a narrow overhanging lip across the top of the circular recess to frictionally hold the pot in place. A stacking means is provided in the design of the apparatus to facilitate the nesting of two or more of the apparatus in a reduced space. This stacking means is a hollow area beneath the holding means to permit one of the apparatus to be inserted and nest into the base means of another of the apparatus, each of the apparatus having a holding means of like dimensions. A modification of the present invention provides a stacking means which is a hollow area beneath the holding means to permit one of the apparatus to be inserted and nest into the base means of another of the apparatus, the holding means of one of the apparatus being larger than the holding means of the other apparatus.

OBJECTIVES OF THE INVENTION

The objectives of the present invention are to provide a small potted plant display stand which is:

(1) small and light weight;
(2) durable;
(3) stable;
(4) capable of holding a small potted plant at varying degrees to the horizontal for better viewing;
(5) easy to clean;
(6) stackable;
(7) more simple and inexpensive to manufacture than display stands known in the prior art;

Other objectives and advantages of the present invention will be apparent during the course of the following detailed description.

DETAILED DESCRIPTION OF THE PREFERRED EMBODIMENT OF THE INVENTION

Figure 1:
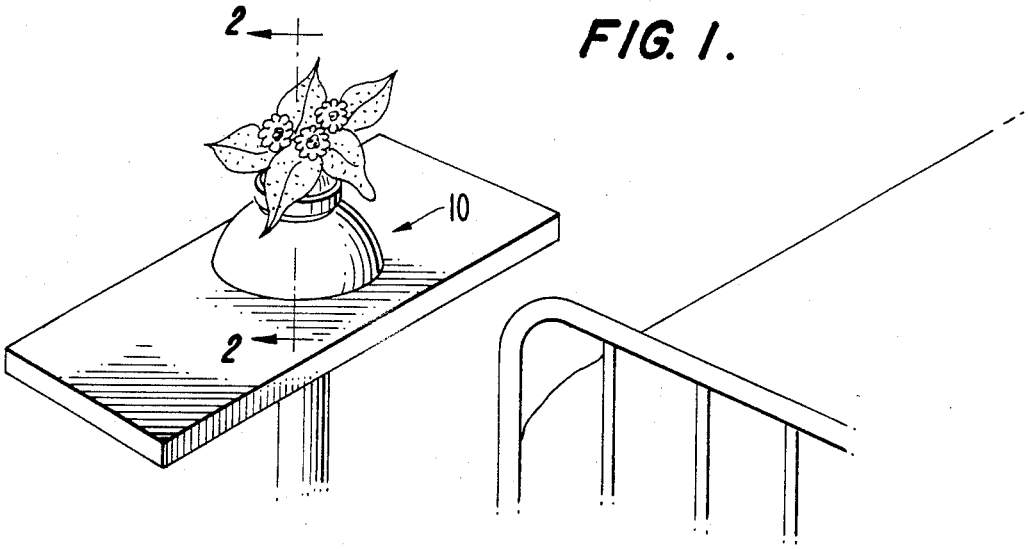
FIG. 1 is a perspective view, from the front, of a Potted Plant Display Stand constructed in accordance with the principles of the present invention, showing the base means and the fuller view provided of the contents of the apparatus.
Figure 2:
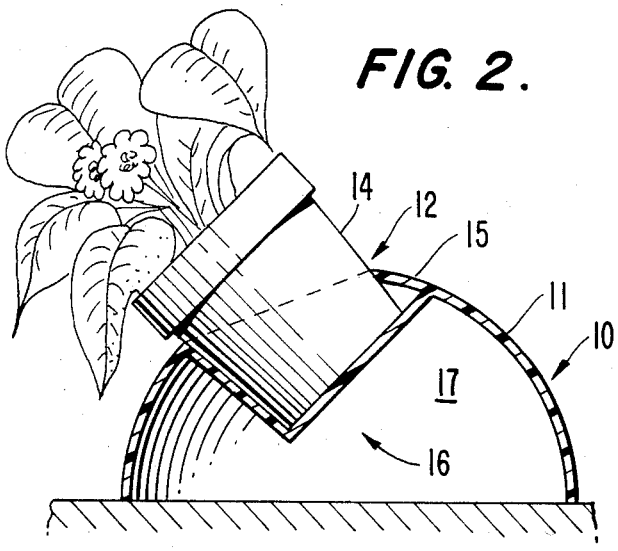
FIG. 2 is a sectional view of the same present invention taken along line 2—2 of FIG. 1, from the direction of the arrows, showing the position of the circular recess in the side of the apparatus and the narrow overhanging lip across the top of the circular recess.

The Potted Plant Display Stand is a small, compact, lightweight apparatus for displaying a small potted plant at varying inclined angles to the horizontal. Throughout the following detailed description of the present invention, like reference numerals are used to denote like parts disclosed in the accompanying drawings, FIGS. 1–5. Corresponding parts of a modification of the present invention are denoted by a prime following the reference numeral.

As shown in FIGS. 1–5, the Potted Plant Display Stand has a base means, shown generally at reference numeral 10, for supporting the apparatus on a horizontal surface, such as the bedside table illustrated in FIG. 1. Base means 10 is a hollow, dome-like shell 11, circular in shape, constructed (preferably molded) of thin, lightweight material, such as plastic. A holding means, shown generally at reference numeral 12, is provided in the apparatus for holding the small potted plant at an inclined angle (20 to 70 degrees) to the horizontal, for ease of viewing the contents of the apparatus by a bedridden observer. Holding means 12 is a cup-like, circular recess 13 in the side of the apparatus. Circular recess 13 is slightly larger in circumference than the outer circumference of the pot 14 being held. Circular recess 13 has a narrow overhanging lip 15, across the top of circular recess 13, to frictionally hold pot 14 in place.

Figure 4:
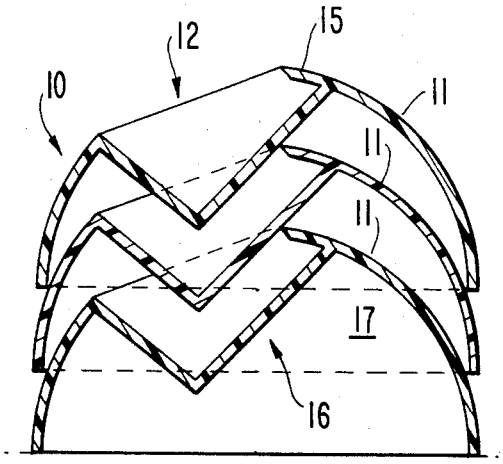
FIG. 4 is a sectional view of the same present invention from the right side, showing the manner is which apparatus having holding means of like dimensions nest into one another.
Figure 3:
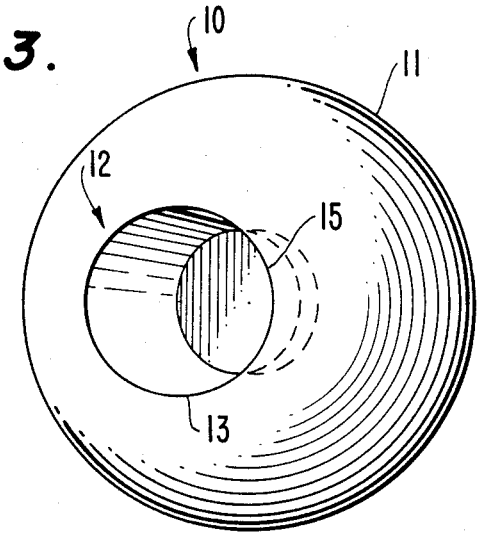
FIG. 3 is a plan view of the same present invention showing the circular recess and the top of the hollow, dome-like shell.
Figure 5:
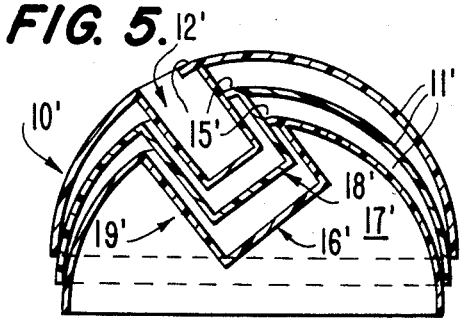
FIG. 5 is a sectional view from the right side of a modification of the present invention, showing the manner in which apparatus having holding means larger than each other nest into one another.

A stacking means, shown generally at reference numeral 16 in FIG. 4, is provided in the apparatus to facilitate the nesting of two or more of the apparatus in a reduced space. Stacking means 16 is a hollow area 17, beneath holding means 12, to permit one of the apparatus to be inserted and nest, as best shown in FIG. 4, into the base means 10 of another of the apparatus having holding means 12 of like dimensions. A modification of the present invention is shown in FIG. 5, wherein stacking means, shown generally at reference numeral 16', is hollow area 17', beneath holding means 12', to permit one of the apparatus to be inserted and nest into base means 10' of another of the apparatus, holding means 12' being larger than holding means 18'and 19' of the other apparatus.

I claim:

1. Apparatus for displaying a small potted plant which comprises:

a hollow, dome-like shell, circular in shape, constructed of thin, lightweight material, preferably plastic, for supporting said apparatus on a horizontal surface; and a cup-like circular recess in the side of said apparatus, said circular recess being slightly larger in circumference than the outer circumference of the pot being held, for holding said small potted plant at an inclined angle to the horizontal, for ease of viewing the contents of said apparatus by a bedridden observer and which said circular recess has a narrow overhanging lip across the top of said circular recess to frictionally hold said pot in place.

2. The apparatus of claim 1 wherein said circular recess is inclined at angles varying from 20 to 70 degrees to the horizontal.

* * * * *